United States Patent [19]

Marchant

[11] 4,177,791

[45] Dec. 11, 1979

[54] WOOD-BURNING STOVES

[75] Inventor: Nicholas G. Marchant, Newbury, England

[73] Assignee: Waterford Ironfounders Limited, Bilberry, Ireland

[21] Appl. No.: 870,062

[22] Filed: Jan. 17, 1978

[30] Foreign Application Priority Data

Sep. 6, 1977 [GB] United Kingdom ..... 37083/77

[51] Int. Cl.[2] ..... F24B 3/00; F24C 1/14

[52] U.S. Cl. ..... 126/65; 126/66; 126/77; 126/193

[58] Field of Search ..... 126/126, 65, 104 R, 126/114, 60, 62, 58, 66, 77, 83, 307, 82, 193, 315, 289

[56] References Cited

U.S. PATENT DOCUMENTS

| | | | |
|---|---|---|---|
| 38,194 | 4/1863 | Woolson | 126/77 X |
| 167,594 | 9/1875 | White | 126/60 |
| 188,475 | 5/1877 | Martin | 126/65 X |
| 612,004 | 10/1898 | Keep | 126/58 |
| 689,078 | 12/1901 | Hartford | 126/104 R |
| 876,909 | 1/1908 | Oblinger | 126/83 |
| 1,768,584 | 7/1930 | Eaglesfield | 126/114 |
| 2,400,150 | 5/1946 | Jones et al. | 126/114 X |
| 3,880,139 | 4/1975 | Young | 126/126 X |

FOREIGN PATENT DOCUMENTS

| | | | |
|---|---|---|---|
| 607776 | 9/1960 | Italy | 126/307 |
| 128863 | 7/1950 | Sweden | 126/65 |

*Primary Examiner*—Samuel Scott
*Assistant Examiner*—Randall L. Green
*Attorney, Agent, or Firm*—Larson, Taylor and Hinds

[57] ABSTRACT

A store having a parallelepiped-shaped combustion chamber and a parallelepiped-shaped flue chamber smaller in all dimensions than the combustion chamber and with four similar shaped flue outlet frames on the top, rear and sides thereof. The stove includes one flue outlet collar and three blanking plates which can be fitted in any chosen arrangement to the flue outlet frames. The stove has a lift-off hob giving access to the flue chambers even when the flue outlet collar is fitted in the top outlet frame. The fire door occupies the full frontal area of the combustion chamber and the side walls are each formed in two parts of substantially uniform section. The combustion chamber base has sinuous finning.

6 Claims, 3 Drawing Figures

WOOD-BURNING STOVES

BACKGROUND OF THE INVENTION

This invention relates to wood-burning stoves. Known wood-burning stoves consist primarily of a chamber formed of cast iron and defined by a base, side panels, a rear panel, a front panel with a fire door and ventilator, a hob or decorative top panel, and a baffle plate occupying a rearward upper horizontal plane in the chamber so that said chamber is divided into a combustion chamber or fire box below the baffle plate and a flue chamber above the baffle plate with a flue outlet from the flue chamber.

For a given size of stove such a structure can involve, especially for the side panels, large castings, restricted shape options and restricted flue outlet options. The fire door in a front panel gives limited access to the combustion chamber and current hob designs with a top flue outlet present difficulties in access for flue cleaning.

SUMMARY OF THE INVENTION

The objects of the invention are to provide a wood-burning stove improved in the sense that it can be constructed—for a given size of stove—with components of smaller size than hitherto, and may have more versatile flue outlet collar positioning. The stove can have an improved fire door arrangement to give easy access to the combustion chamber to facilitate maximum filling of the stove, and an improved hob which, whilst giving easy access for flue cleaning, allows a top flue outlet to be provided independent of the hob.

These objects are realised in a stove according to the invention which comprises a combustion chamber defined by a base panel, side panels, rear panel, front frame, a fire door with ventilator on the front frame, top frame and a horizontally-disposed baffle plate occupying the rearward region of the top frame to leave an opening forward of said baffle plate for the escape of gases upwardly from the combustion chamber; the stove also comprising a flue chamber above the combustion chamber, to accept gases therefrom, said flue chamber being defined by said baffle plate, a front panel, forwardly located partial side panels, rearwardly located side flue opening frames, a rear flue opening frame, a top hob flue opening frame, a removable flue outlet collar in one of said flue opening frames, removable blanking plates in the other said opening frames, and a lift-off hob panel apertured at the region of said upper flue opening frame to fit around said frame so that, when said flue outlet collar is in the top flue opening frame, the hob can be lifted and moved independently to give access for cleaning without necessitating removal of the flue collar.

The hob panel preferably has underside finning to aid heat transfer from the flue gases to the hob.

The combustion chamber base panel preferably has topside sinuous finning to strengthen the base panel whilst providing, at the same time, means to retain a uniform layer of heat insulating sand on the base panel.

The combustion chamber side panels are preferably formed of two similar sub-panels of substantially uniform section so that casting can be performed with less risk of casting fractures. The two parts preferably include vertical external finning to aid heat transfer.

The fire door preferably occupies the full frontal area of the stove.

BRIEF DESCRIPTION OF THE DRAWINGS

The invention will now be described further with reference to the accompanying drawings in which.

DESCRIPTION OF THE PREFERRED EMBODIMENTS

Figure 1:
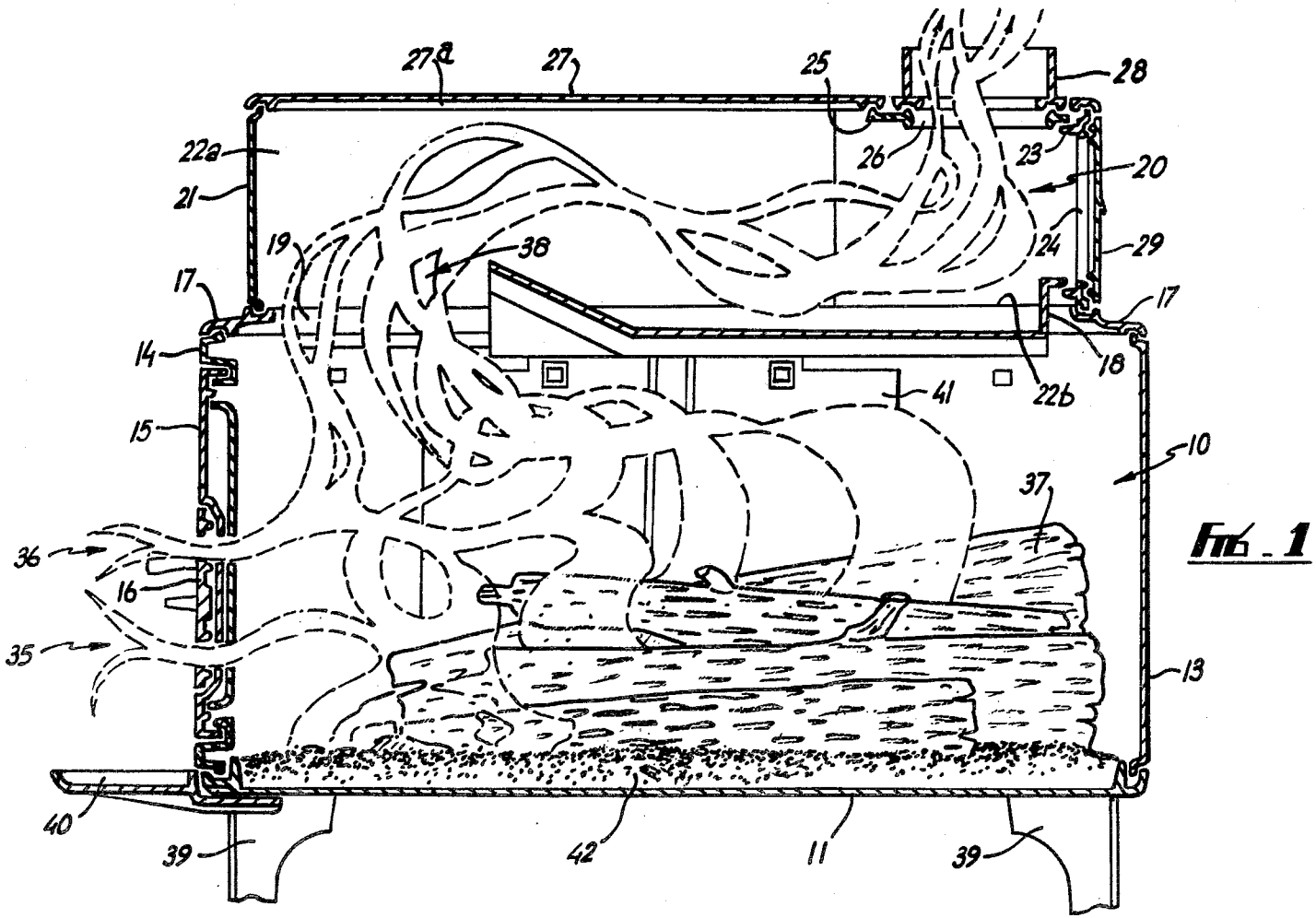
FIG. 1 is a longitudinal sectional elevation of a stove according to the invention.

The stove has a parallelepiped-shaped combustion chamber or fire-box 10 defined by a base panel 11, side panels 12, a rear panel 13, a front frame 14, a fire door 15 with ventilator 16 and handle 42 on the front frame, a top frame 17, and a horizontally disposed baffle plate 18 occupying the rearward region of the top frame to leave an opening 19 forward of the baffle plate for the escape of gases upwards from the combustion chamber 10 into a flue chamber 20. The side panels 12 are each formed by the parts **12*a* and 12*b*** of substantially uniform section.

The flue chamber 20 is also parallelepiped-shaped and is of smaller dimensions in all elevations and plan than the dimensions of combustion chamber 10. The chamber 20 is defined by said baffle plate 18, a front panel 21, forwardly located partial side panels **22*a* in side frames 22, rearwardly located side flue opening frames 22*b*, a rear flue opening frame 23 defining a flue opening 24, a hob flue opening frame 25 giving a rearwardly positioned flue opening 26, and a lift-off hob 27. The frames 22*b* have flue openings 30 and 31. The hob 27 is apertured at 27*b* in the region of the frame 25**.

Figure 2:
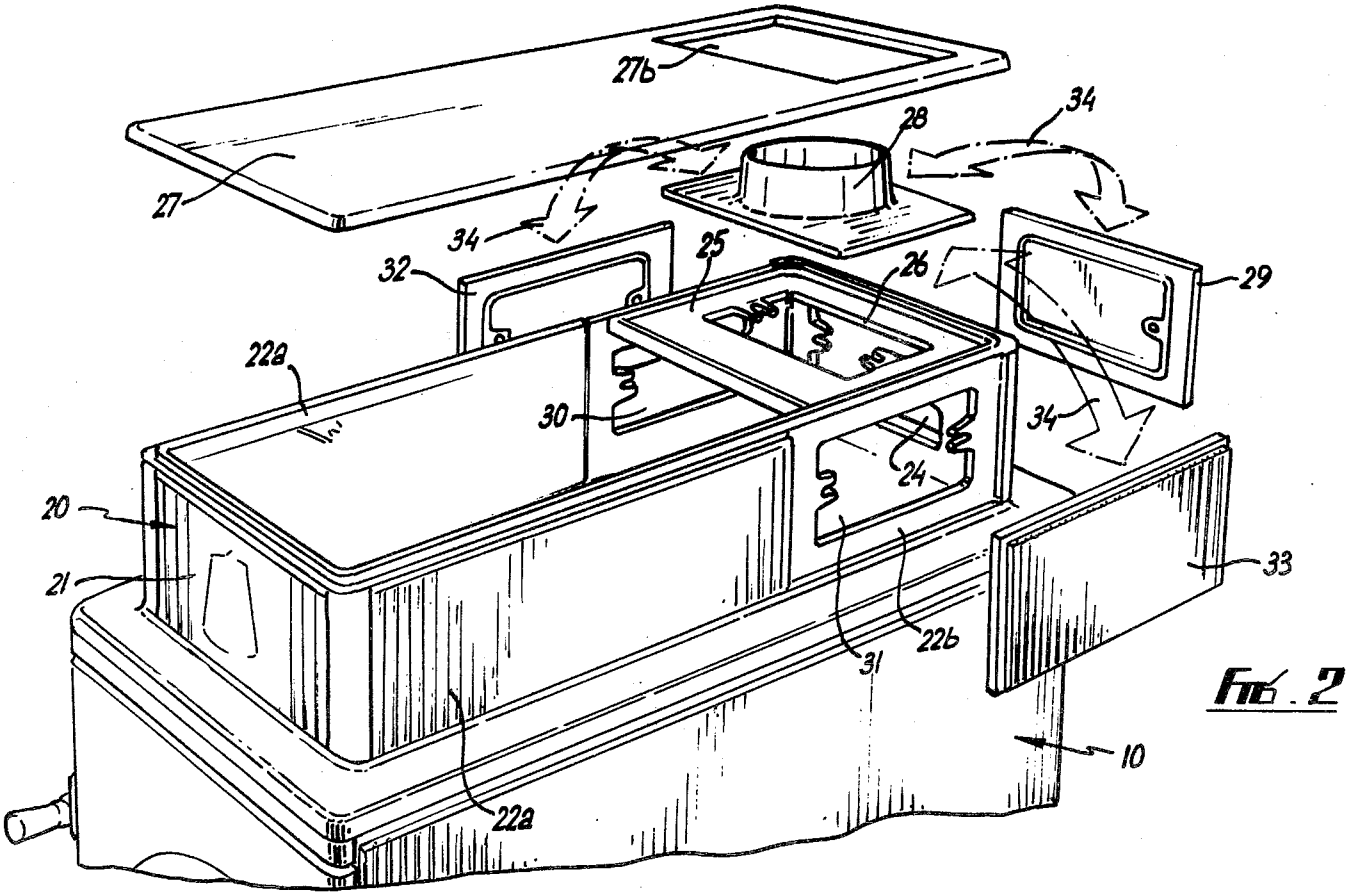
FIG. 2 is a perspective diagrammatic exploded view of the flue chamber of the stove to illustrate the interchangeability of flue outlet and baffle plates.
Figure 3:
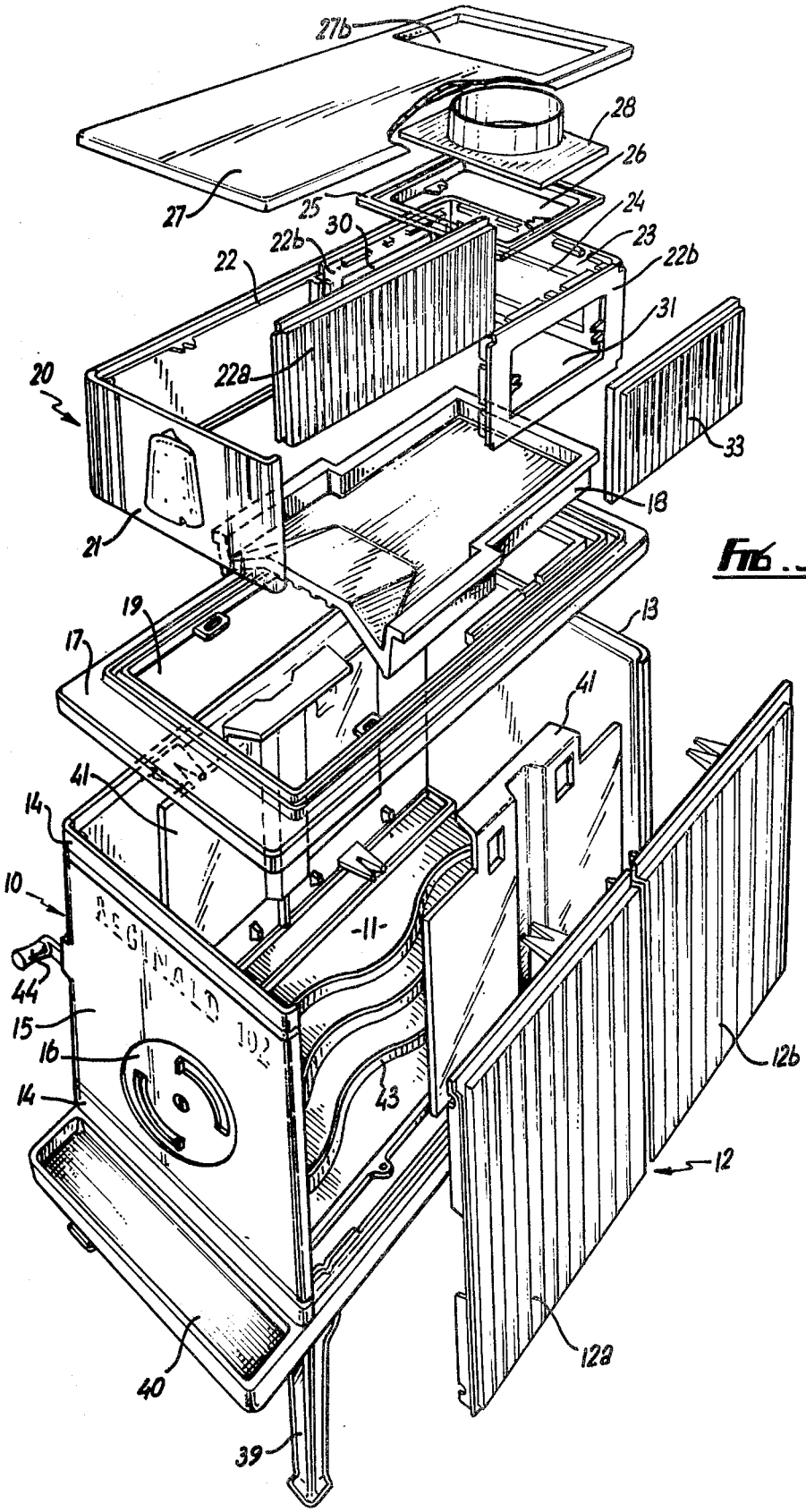
FIG. 3 is a perspective exploded view.

The opening 26 has a removable flue outlet collar 28 and the openings 24, 30 and 31 have respective identical removable blanking plates 29, 32 and 33. The frames 23, 25 and **22*b* are similar to the extent that they will accept either the flue outlet collar 28 or a blanking plate 29, 32 or 33 as indicated by arrows 34** in FIG. 2.

The fire door 15 occupies the full frontal area of the combustion chamber and thus allows the chamber 10 to be filled easily to capacity. The ventilator 16 allows for the entry of primary air 35 and secondary air 36. The primary air enters the region occupied by burning logs 37 on an ash or sand bed 42 and the secondary air mingles with combustion gases from the logs 37 to achieve a more complete combustion and the final combustion gases 38 pass from the combustion chamber 10 into the flue chamber 20 via the opening 19. The stove is supported on legs 39 and has a dished ash-catching tray 40. The combustion chamber has freely hung side baffle plates 41.

The hob 27 has an underside equipped with fins **27*a* to give an improved heat convection surface. With the collar 28 in the upper opening 26 the hob 27 can be removed by lifting off and even swung if convenient without having to release screws or catches and when so removed the flues of the stove are readily accessible for cleaning. The side panels 12 and 22*a* and parts of the front panel 20 has vertical external finning to aid heat transfer. The blanking plates also have vertical external finning. The base panel 11 has sinuous finning 43 to strengthen the base panel whilst providing, at the same time, means to retain the bed 42** as a uniform layer.

What I claim is:

1. A wood-burning stove comprising a combustion chamber defined by a base panel, side panels, rear panel, a front frame, a fire door and ventilator on the front frame, a top frame, and a horizontally disposed baffle plate occupying the rearward region of the top frame to leave an opening forward of said baffle plate for the escape of gases upwardly from the combustion chamber; the stove also comprising a flue chamber above the combustion chamber to accept gases therefrom, said flue chamber being defined by said baffle plate, a front panel, side panels, a rear frame defining a rear flue opening, an upper frame defining an upper flue opening, a liftable and movable hob panel apertured in the region of said upper flue opening, a removable flue outlet collar in one of said flue openings and a removable blanking plate in the other of said openings so that, when said flue outlet collar is in the top flue opening frame, the hob can be lifted and moved independently of the collar to give access for cleaning.

2. A wood-burning stove as claimed in claim 1 in which said hob-panel has underside finning.

3. A wood-burning stove as claimed in claim 2 in which the base panel of the combustion chamber has sinuous topside finning.

4. A wood-burning stove as claimed in claim 1 in which the side panels of the combustion chamber comprise two sub-panels arranged side by side of substantially uniform section.

5. A wood-burning stove as claimed in claim 4 in which said fire door occupies the full frontal area of the combustion chamber.

6. A wood-burning stove comprising a parallelepiped-shaped combustion chamber defined by a base panel having topside sinuous finning, side panels each formed by two sub-panels side-by-side with vertical external finning, a rear panel, a front frame, a fire door with a ventilator swung on the front frame to occupy the full frontal area of the combustion chamber, a top frame, and a horizontally-disposed baffle plate occupying the rearward region of the top frame to leave an opening forward of said baffle plate for the escape of gases upwardly from the combustion chamber; the stove also comprising a parallelepiped-shaped flue chamber above the combustion chamber, to accept gases therefrom, said flue chamber being defined by said baffle plate, a front panel, forwardly located partial side panels, rearwardly located side flue opening frames, a rear flue opening frame, an upper hob flue opening frame, a removable flue outlet collar in one of said flue opening frames, removable blanking plates in the other said opening frames, and a lift-off hob panel having underside finning and apertured at the region of said upper flue opening frame to fit around said frame.

* * * * *